US005305817A

United States Patent [19]

Borisov et al.

[11] Patent Number: 5,305,817

[45] Date of Patent: Apr. 26, 1994

[54] METHOD FOR PRODUCTION OF METAL BASE COMPOSITE MATERIAL

[75] Inventors: Valery G. Borisov; Ljudmila P. Borisenko; Alexandr V. Ivanchenko; Nikolai A. Kaluhsky, all of Leningrad; Alexandr P. Bogdanov, Budapeshtskaya; Vladimir M. Rapoport, Leningrad; Nikolai N. Belousov, Leningrad; Svetlana N. Pavlova, Leningrad; Tatyana I. Belyaeva, Leningradskaya; Vladimir V. Volkov, Leningrad; Viktor S. Shusterov, Leningrad, all of U.S.S.R.

[73] Assignee: Vsesojuzny Nauchno-Issledovatelysky I Proektny Institut Aluminievoi, Magnievoi I Elektrodnoi Promyshlennosti, Leningrad, U.S.S.R.

[21] Appl. No.: 740,823

[22] Filed: Aug. 8, 1991

[30] Foreign Application Priority Data

Sep. 19, 1990 [SU] U.S.S.R. ..... 4867973

[51] Int. Cl.[5] ..... B22D 19/14

[52] U.S. Cl. ..... 164/97; 164/103

[58] Field of Search ..... 164/91, 97, 98, 103

[56] References Cited

FOREIGN PATENT DOCUMENTS

| | | | |
|---|---|---|---|
| 8900057 | 2/1989 | Australia . | |
| 802133 | 12/1968 | Canada | 164/97 |
| 56-14960 | 2/1981 | Japan . | |
| 511996 | 6/1976 | U.S.S.R. | 164/97 |
| 0671919 | 7/1979 | U.S.S.R. | 164/97 |
| 1412881 | 7/1988 | U.S.S.R. | 164/97 |
| 2219006 | 11/1989 | United Kingdom | 164/97 |

OTHER PUBLICATIONS

Cast Al-Graphite Part, Composites-A Potential Engineering, Dr. P. K. Rohatgi, vol. 67, Mar. 1987.

Solidification, Structures, and Prop. of Cast Metal-Ceramic Composites, Dr. P. K. Rohagi, IMR Dec. 1986, vol. 31, No. 3, p. 115.

Wettability of Graphite to Liquid Al. and the Effect of Alloying Elements on it, Takao Choh, Dec. 1987.

O. V. Abramov-Action of High Intensity Ultrasound on Solidifying Metal Rod. Feb. 13, 1986-Revised Jul. 14, 1986-Mar. 1987 pp. 73-81.

*Primary Examiner*—Paula A. Bradley

*Assistant Examiner*—Rex E. Pelto

[57] ABSTRACT

A method of making a composite material consists of entraining finely divided solid additive particles in a stream of ionized inert gas and ionizing the inert gas and utilizing heat generated by the ionized gas to heat the solid particles to a high temperature which is less than the temperature in at which the solid particles become non-solid due to melting sublimination or dissociation. Then, injecting the stream of gas and entrained heated solid particles into a molten metal mass to provide a mixture of finely divided solid particles and molten metal and thereafter causing physical agitation of the mixture of molten metal and solid particles to establish a substantially uniform distribution of solid particles in the molten metal. Such physical agitation of molten metal is continued until the mixture of finely divided particles and metals is completely solidified.

18 Claims, 4 Drawing Sheets

METHOD FOR PRODUCTION OF METAL BASE COMPOSITE MATERIAL

FIELD OF THE INVENTION

The present invention relates to the metallurgical field, and more specifically to a method for the production of cast base metal material having distributed therein very fine particles which can be particles of ceramics, metals, alloys, intermetallics, carbides, nitrides, borides and substances useful in enhancing properties of the base metal.

BACKGROUND OF THE INVENTION

Development of the aircraft and ship building, car making and a number of other industries require new materials having improved workability and service properties.

Metallic structural materials (alloys) are nowadays produced by melting the base metal to liquid form with additive components, with the melting process going at the temperature of the entire system which ensures the complete melting and mutual dissolution of the components (FIG. 2*a*).

With the drop of temperature of the alloy during cooling and solidification, the solubility of the alloy components sharply decreases and, at a certain temperature particular for each alloy system and composition, solid phases begin to precipitate and grow from the homogeneous melt in the form of alloy component crystals, or, more frequently, in the form of the crystals of the chemical compounds of components (intermetallic phases) (FIG. 2, *b,c*). With further cooling the rest of the melt is crystallized in the form of a solid solution of the components in the base metal (FIG. 2, *d*). Intermetallic phases with crystal lattice and properties different from those of the base alloy (matrix) strongly affect the properties of the alloy system as a whole.

The size of the intermetallic phases precipitated in the process of crystallization of the alloy should not exceed fractions of one micron, otherwise quality of the alloy will be sharply impaired due to loss of ductility and strength.

The solubility of metals and metalloids in the metallic matrix is very much limited in the solid state and this factor accounts for the narrow selection of commercial alloys and the practically achieved limit of improvement in the properties of the commercial structural alloys by change in composition.

A new class of structural materials have been developed, which contain artificially incorporated particles or fibers of oxides, carbides and other compounds enabling the attainment of assured properties of the system as a whole. Such materials are known as composites since the components of the metallic system are not precipitated from the matrix metal, as is the case with the conventional alloys, but are artificially incorporated into the system. All known metallic alloys representing the matrix with incorporated particles, whose properties significantly differ from the matrix, are basically the composites, although of natural occurrence in the making of the alloy.

The properties of metallic materials represented by a composite system of artificial or natural origin are indicated as follows:

- ductility of the material is determined by ability of the matrix (as a rule the ability of the solid solutions of components in the base alloy) for plastic flow, as well as by size and syngonia (crystalline structure) of intermetalloid and other inclusions in the matrix);
- strength, heat resistance, fatigue strength, resistance of materials to development of cracks is determined by interaction of the of the inclusions and the matrix, as well as distortions of the crystalline lattice of the matrix under action of inclusions;
- hardness, wear resistance, tribotechnical properties of the material are determined by properties of the inclusions;
- modulus of elasticity, linear expansion factor, specific weight (density) of the material are determined by a set of properties of the matrix and inclusions.

Thus, the development of new metallic materials with a predetermined combination of workability and service properties should be theoretically achievable on the basis of selection of the optimum composition of the metallic system in each case, that is selection of the matrix and inclusions whose properties and interaction determine the properties of the composite system as a whole.

Selection of the metallic system base (matrix) is determined by required service properties of the material and level of its properties (steel, aluminum, copper, magnesium, nickel, etc.).

The major difficulty in implementation of the technology for production of structural metallic materials is the injection of components into the structure in the form of superfine particles of compounds thermodynamically and thermally stable in the matrix, and which measure from a few nanometres to a few microns.

In the production of natural composite metallic materials (i.e. complex alloys) this problem is dealt with by precipitation of particles (intermetalloids) from supersaturated solid solutions of the components of the alloy in the base metal produced by the use of high-rate cooling of homogeneous melts The required cooling rate can be practically achieved only in case of relatively small quantities of alloy melt In practice, a high cooling rate is provided by physical dispersion of the melt followed by cooling fine drops of the melt in a cooling medium This requires expensive operations of drying, degassing and compacting particles (granules) to provide pellets. Thus, the technology for production of new metallic alloys by the pelletizing technique has not found wide use in the industry.

The difficulty of introducing superfine particles into the metallic melts in attributed to two circumstances. First due to lack of fluidity of superfine particles (thousandths of microns or less in size) the metering of particles when injected into the melt is rather difficult or sometimes even impossible. Second, due to presence of adsorbed oxygen on the surface of the particles upon in contact with the melt, oxides of the base metal are formed on the surface, which prohibits wetting of the particles by the melt. This problem especially manifests itself during injection of the particles into the melts of metals having high oxygen reactivity (aluminum, magnesium, etc.). The above factor also inhibits implementation of such techniques as the direct modification of the alloys by injection of particles—crystallization nuclei into the melt, alloying the melts by injection of alloy components in the form of the powder, use of powdered waste of alloying materials (e.g. silicon) in production of alloys, in particular those of aluminum-silicon system.

One of the most important features of the proposed technology and devices for its implementation is the possibility of injection into the melt of fine particles of the filler materials (in case of production of composites) or structural components (in case of production of alloys), with the formation of the alloy structure following the scheme shown in FIG. 2A.

The matrix free from the atoms of the component is injected with particles of a desired filler material (FIG. 3*a*). When equilibrium of the system exists between the structural component (Ax By) and solution of the alloy component B in the matrix A, particles incorporated into the matrix dissolve to the concentration of saturation at the appropriate temperature with the decrease in size, this process is highly controllable and enables production of alloys with structure with alloy a predetermined component of limited solubility.

Major stages of a process for the production of cast composite materials involved are described in "Solidification, Structures and Properties of Cast Metal-Ceramic Particle Composites"—Rohatgi P. K., Asthana R., Das S.—Inst. Metal Rev.,—1986—Vol. 31, N3—pp. 15-139 and include:

produotion of the basic melt;

uniform distribution of solid particles in a mass molten metal;

crystallization of the resultant composite material.

The following methods have been used in the prior art for injection of superfine particles into a melt as described in "Cast Aluminum-Graphite Particle Composites—a Potential Engineering Material"—Rohatgi P. K., Das S., Dan T. K.—J. Inst. Eng.,—March, 1989—Vol. 67, N2—pp. 77-83:

mechanical stirring of the melt and added particles;

pressing pellets mixed powered matrix metals and reinforcing particles followed by plunging the particles to the melt and mechanical stirring of the melt;

dispersion of particles in melt by ultrasound irradiation.

Problems encountered in the production of cast metal composites relate to lack of or low wetability of the reinforcing filler particles with the matrix melt, as well as non-uniformity of the cast material due to large differences in densities between the matrix and the filler material.

Increase in the strength of the bond between the reinforcing filler particles and the base metal matrix is achieved by a number of techniques as described in "Wetability of Graphite to Liquid Aluminum and the Effect of alloying Elements on It", Choh Takao, Kemmel Roland, Oki Takeo—Z. Metallklunde"—1987—Vol. 78, N4—pp. 286-290, i.e.:

application of metal-philic coatings on the surface of the reinforcing filler particles;

introduction of surfactants into the base metal melt;

increase of the melt temperature.

There is also known a method for production of composites (Application No. 56-141960, Japan, dated Aug. 4, 1980 (No. 55-45955), published May 11, 1981) in which is suggested the use as a filler of natural hollow microspheres 150 micron in diameter sufficiently compatible with various metallic materials, as well as graphite powders, $TiB_2$, aluminum nitride and oxide, flaky and chipped graphite and calcium metal is added to the melt in quantity of 0.05-5.0 wt. % to ensure uniformity of materials.

The major disadvantage of this method is the necessity for introduction into the melt of an element (calcium) which is soluble in the liquid base metal, but practically insoluble in the case solid matrix and which forms a brittle eutectic component with the matrix. This results in lowered mechanical properties of the matrix and of the composite itself. Besides, the use, as a filler, of hollow microspheres of the recited sizes (150 micron) does not help to improve absolute values of mechanical properties and can result only in some improvement in their relative values per unit of mass.

Prior art relevant to the present invention is the method for production of composite materials (Met. Trans., 1978, v. 9 N 3, pp. 383-388) using the base molten metals—Mg. Al, Fe, Ni, Cr, Co doped with insoluble oxide particles ($Al_2O_3$, BeO, CaO, $CeO_2$, $TiO_2$, MgO, $ThO_2$, $VO_2$, $ZrO_2$), carbides, borides, nitrides of Nb, Ta, Hf, Ti, Zr sized 0.01-10 micron. The particles are injected as powder or thin fibers To ensure uniform distribution of the particles in the melt they are injected in a stream of preheated inert gas (Ar, He) while vigorously stirring the base metal. Volume percentage of particles may range from 0.5 to 20%. Also one of the elements which improve the surface activity at the interface the particle-melt is injected into the molten metal. Injection of such surface active metals (Mg, Si, Ti, Zr, V, Nb) ensures formation of a metalphilic casing on the oxides which significantly improves wetability in the system and there is no segregation in the melt over a period of 30 min.

The foregoing method has the following disadvantages:

1) the chemical composition of the matrix melt is limited by need to inject surface active metals which in a number of cases may lead to impairment of technological and mechanical properties of the resulting composite material;

2) the absence of stirring in the course of solidification promotes, especially in case of a long solidification time, the formation of segregated and laminated areas, and consequently quality of the resulting composite material is lowered;

3) insolubility of the reinforcing particles excludes the possibility of using this method for production of materials with the matrix reinforced with superfine particles of those elements or their compounds which are traditional strengtheners in production of materials by joint crystallization of the base metal with alloying additives and subsequent thermo-mechanical working.

SUMMARY OF THE INVENTION

An object of the present invention is improvement in quality of composite materials by increasing the uniformity of dispersion of reinforcing filler particles and the strength of their adhesion with the base metal matrix and the ability to provide an expanded group of composite materials by the use of a wide range of ceramic particles, metals and intermetallics including carbides, nitrides, borides, oxides, graphite and glasses.

The foregoing object and other objects are achieved by a method of making composite materials which includes the steps of entraining finely divided solid additive particles, e.g. of a ceramic, metal, intermetallic including oxides, borides, carbides, nitrides, graphite, glasses in an inert gas and ionizing the entraining inert gas to heat the solid particles to a high temperature which is less than the temperature at which the particles become non-solid due to melting, sublimation, or dissociation, but more than about ½ of such temperature, and injecting a stream of the ionized entraining gas and entrained heated solid particles into a molten metal mass while maintaining a stirring movement in the mass of molten metal sufficient to promote and to maintain dispersion of the added particles to solidify in a composite mass while maintaining a stirring movement in the solid particle-containing molten metal until solidification thereof is complete.

DETAILED DESCRIPTION OF THE PREFERRED EMBODIMENT

Figure 1:
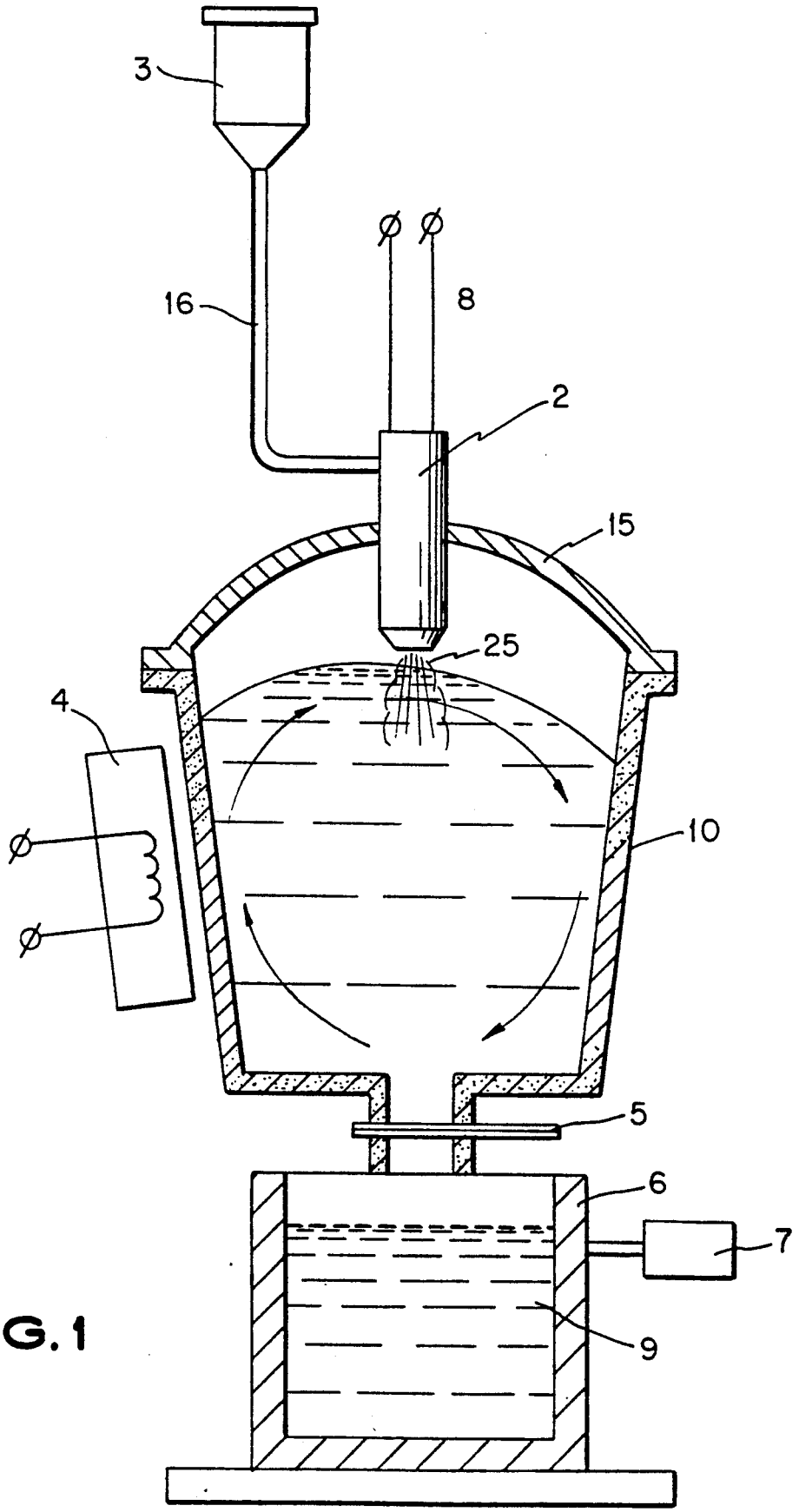
FIGS. 1, 4(A) and 4(B) and 5 show apparatus for the practice of various embodiments of the invention.
Figure 2:
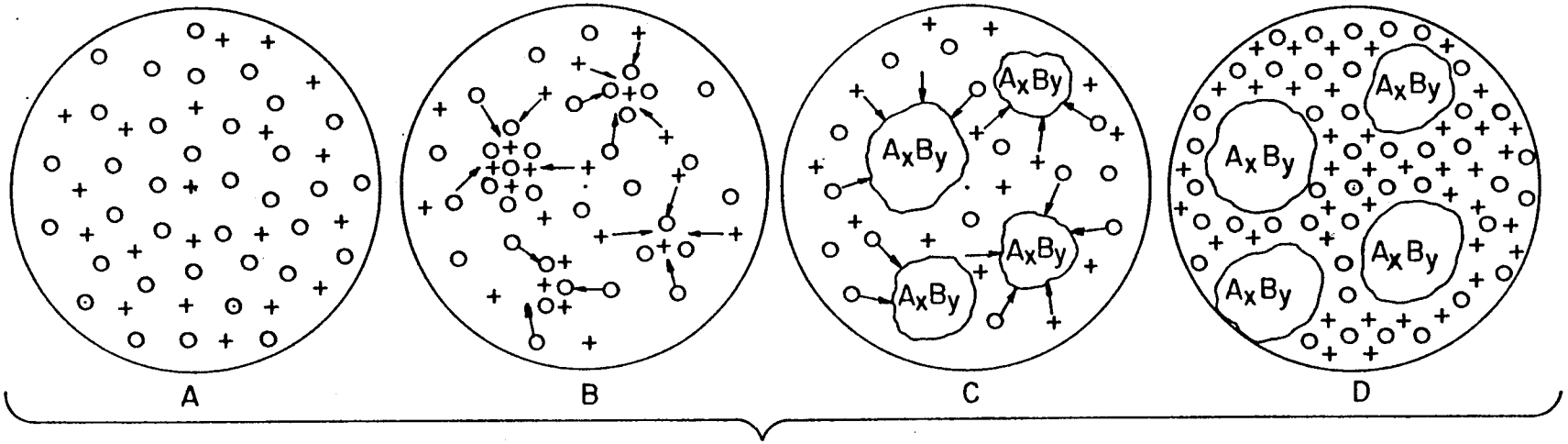
FIGS. 2A–D and 3A–D are representations of metallurgical conditions which occur in the course of alloy formation.
Figure 3:
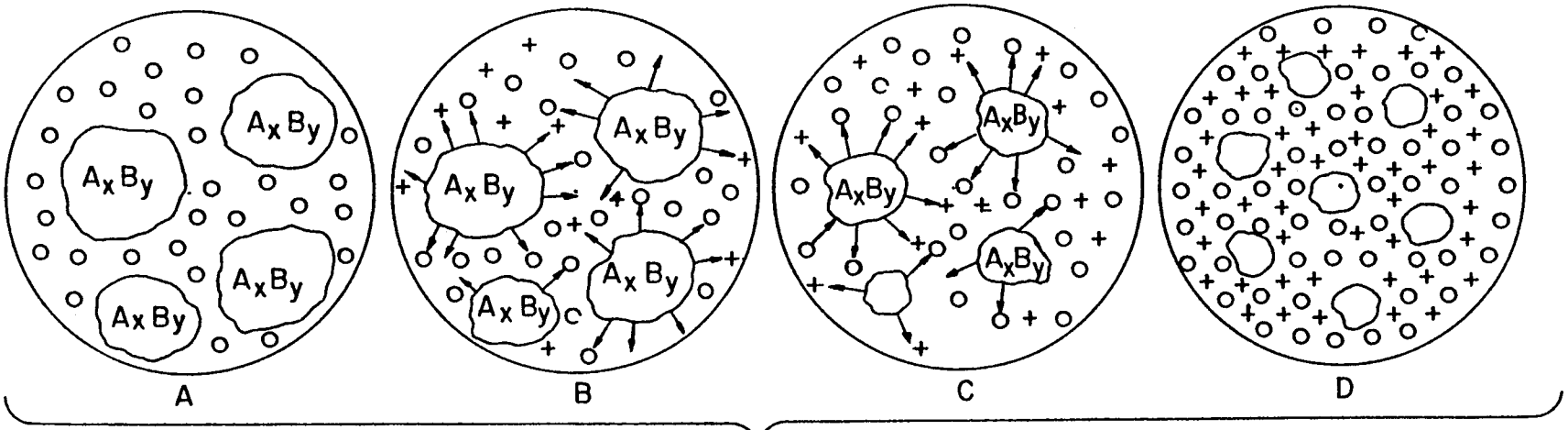

In the practice of the present invention, the base metal melt can be aluminum, iron, copper, magnesium, nickel, cobalt, chromium. Suitable base metals are alloys of the above-mentioned metals in which they are the predominant constituent, such as aluminum containing up to 40% by weight manganese, and steels, and cast iron and ductile iron materials. Also suitable as base metals are magnesium, copper, nickel, titanium and alloys thereof.

The reinforcing filler addition particles are very fine and average from 1–100 micron in size. The particles can be metals which do not form chemical compounds with the matrix elements, such as Si in Al; intermetallics such as: $TiAl_3$, $ZrAl_3$, $FeAl_3$, $Fe_2Al_5$, $CrAl_7$, $CrAl_3$, $NiAl_3$, $Co_2Al_9$, $ScAl_3$; carbides such as:SiC, TiC, WC, NbC, $Fe_3C$; nitrides such as TiN, $Si_3N_4$, ZrN; borides such as $TiB_2$, $AlB_2$; oxides such as: $ZrO_2$, $Al_2O_3$; and also other ceramic materials such as sapphire, glasses, graphite and carbo-nitrides. Other particle materials used in the dispersion strengthening of metals can be used, provided they satisfactorily retain thermodynamic stability throughout the steps of the present process.

The entraining inert gases used in the present invention are preferably argon or helium although other inert gases are usable. The inert gas is ionized and the entrained particles are preheated in the ionized gas prior to being injected into the melt to a high temperature below that at which the particles melt or sublime or dissociate; i.e. about 0.9 of the melting point, sublimation temperature, or dissociation temperature as the case may be. At a higher temperature, the particles either agglomerate to produce undesirably large particles in the melt, or result in particles of a composition other than that, intended, or there occurs substantial depletion of the desired amount of particles in the melt. At particle temperatures below about 0.5 of the melting point (sublimation temperature or dissociation temperature) the resulting composite product does not exhibit the increase in strength, hardness and structural uniformity, uniformity of dispersed particles and homogeneity.

The temperature interval for particle preheating was determined experimentally based on the requirement of providing a necessary and sufficient degree of activation for interphase action ensuring a strong bond between the particles and base metal by removal of adsorbed oxygen from the surface of the particles in the course of ion etching and breaking by the particles in the base stream of the molten metal surface.

Determination of the appropriate temperature range applicable to a particular particle material can be determined from published temperature data in hand books or the like and the use of pyrometry devices such as from Agema with precision of ±1° C. However, it is frequently more convenient, particularly when particles such as intermetallics or others are involved and the published data is not conveniently available, to establish base-line conditions. For example, prior to the making of composites, a test run is performed with the gas ionization apparatus to be used for the preheating step, for a particular particle loading and the gas flow and the residence time of the particles in the ionized gas is increased to that just required to melt (volatilize or dissociate) the particle is observed and then slightly reduced to avoid melting, etc. These process conditions then represent the 0.9 melting point temperature. A residence time of about ½ the residence time at which particle melting occurs will correspond to 0.5 melting point. The empirical intervals can similarly be determined by adjusting gas flow and particle loading of the gas following fundamental concepts well known to the art.

A selection of particularly effective particle materials for use in the present invention is listed in Table A hereinbelow with temperature ranges and suitable, exemplary base metal compositions also indicated.

TABLE A

| Particle (Composition) | Particle Size micron | Additive Temperature Range °C. | Base Melt |
|---|---|---|---|
| SiC | 5–50 | 1100–2000 | Al, Al alloys, Al-4% Cu-1.5% $M_g$-0.5% Mn, Fe |
| $Ti\ Al_3$ | 1–10 | 670–1200 | Al, Al alloys, Al-4% Cu-1.5% $M_g$ |
| $Ti\ B_2$ | 5–10 | 1400–2500 | Al, Al base alloys |
| $Si_3N_4$ | 1–5 | 950–1710 | Cu, Ni |
| Graphite | 5–50 | 1800–3240 | Al-12% Si |

In the present invention, from about 0.5% by weight up to about 25% by weight of filler material can be incorporated in a base metal bath of molten metal and the particular material and amount added is determined on the basis of concepts known in the art to achieve a particular enhancement or combination of mechanical properties, e.g. hardness, strength, ductility, elasticity.

Table B hereinbelow shows exemplary particle contents and base materials and an indication of the enhanced mechanical properties

TABLE B

| | Particle (Composition) | Quantity Wt. % | Base Metal (Composition) | Enhanced Property |
|---|---|---|---|---|
| 1. | SiC | 10 | Al | Rm = 200 MPa, E = 120 $\frac{KN}{MM^2}$ $\frac{K_1}{K_2}$ |
| 2. | $ZrAl_3 + Cr\ Al_3$ | 1 + 1 | Al | $\frac{R_{0.2}}{Rm} = 0.99$ |

TABLE B-continued

| Particle (Composition) | Quantity Wt. % | Base Metal (Composition) | Enhanced Property |
|---|---|---|---|
| $TiAl_3$ | 15 | Al | $\frac{S_1}{S_3} = 300$ |

Where:

Rm—temporary tensile strength $R_{0\,2}$—proof stress

E—Modulus of Elasticity

K—rate of linear wear

S—specific density of particles in the matrix 1,2,3—indices applicable to aluminum base composite material, aluminum and Al-10% Ti In the practice of the present invention, it is important that the molten base metal be physically agitated e.g. by being subjected to a stirring force continuously from the commencement of the introduction of solid particles until casting and solidification of the cast metal is complete. Initially, the base melt is in physical agitation, i.e. in a crucible type vessel and a stirring force is suitably and preferably applied to the base metal bath by non-interfering contact magnetic means as know to the art. At this stage of the process mechanical stirring using impellers of known type can also be used. The degree of stirring should vigorous enough e.g. a continuous observable rolling of the bath, to ensure uniform dispersion of the additive particles and test samples can be taken at intervals to so determine. When the particle containing base metal melt is ready for casting the material is transferred directly to a suitable mold and physical agitation is maintained in the molten material in the mold, suitably by vibration, e.g. ultrasound energy coupled to the outside of the mold and causing vibrations in the molten metal until all of the metal in the mold has solidified. The application of ultrasound to provide physical agitation should be of sufficient strength to maintain the uniformity achieved in the crucible but should not result in any significant visible motion of the mass of the molten metal.

In the practice of the present invention the stream of ionized inert gas with entrained solid particles is injected into the base metal bath so that the solid particles enter the bath to a depth of at least 5 cm, e.g. about 10% of the bath depth.

Continuous stirring in the course of change of the volume of the liquid phase from 100% to 0%, i.e. complete solidifioation, is a prerequisite of the present invention for ensuring uniform distribution of reinforcing material in the volume of the matrix enabled by the previous steps of the process and enhancement of wetability at the "particle-melt" interface. Lack of stirring at any stage of liquid-solid state of the composite material can result in weakening the surface contact between the base metal matrix and particles, and the undesirable formation of laminations, segregations and non-uniformities of chemical and structural composition.

The thermodynamic stability of particles in the matrix melt inhibits their chemical action with the base metal and the formation of undesirable compounds of uncontrolled sizes and shapes, thus ensuring, in contrast to the prior art technology, the formation of superfine particle-reinforced alloys by melting the base metal, followed by combined crystallization and heat treatment, and the production of composite materials of "metal-intermetallide (metal)" type with preset values of quantity, sizes and shapes of reinforcing phases.

With reference to FIG. 1, a crucible (10) suitably made of graphite contains a molten metal bath (1) of matrix metal e.g. aluminum which is stirred by way of a conventional magnetic inductor 4 to physically agitate the metal bath (1), preferably in the vigorous rotating motion shown in FIG. 1. The crucible (10) is provided with a protective cover (15) in which is installed an ionization chamber (2) of extended length. Inert gas, e.g. argon is controllably introduced from lines (8) into ionization chamber (2) and the gas is ionized to produce a plasma arc in accordance with known techniques, and very high temperatures are developed in the ionization chamber (2) ranging from 8,000 deg. C to 20,000 deg.C. Finely divided filler material is held in hopper (3) with metering means (not shown) for measuring the weight of finely divided filler material which is introduced via conduit (16) into the ionization chamber (2). The filler particles entering ionization chamber (2) are rapidly heated to a high temperature below that at which melting of the particles occurs, e.g. between 0.5 and 0.9 of the melting point temperature of the particles. The thus heated and activated particles entrained in a stream of the ionized inert gas (25) are introduced into the molten bath (1) by injection of the inert gas and penetration thereof below the surface of the metal bath. The continuous physical agitation of the metal bath (1) by magnetic inductor 4 establishes a uniform dispersion of the solid heated activated filler particles. The temperature of the metal bath is measured, e.g. by thermocouples [not shown) to ensure that the temperature is below that at which undesirable melting or decomposition of the filler particles occurs. Uniformity of dispersion of the filler particles in the bath is established by analyzing samples taken from bath at convenient intervals. When the pre-determined desired amount of solid filler particles have been introduced into the molten metal bath, plug (5) at the base of crucible (10) is opened and molten metal containing the solid additive particles (0) is introduced into mold (6) e.g. suitably made of steel The molten metal is caused to solidify in the mold and surrounds the uniformly dispersed solid filler particles. To ensure that the solid filler particles remain uniformly dispersed in the molten metal phase as solidification progresses, an ultrasound transducer (7) is coupled to mold (5) so that molten metal in the mold is physically agitated by ultrasonic energy vibrations until all of the molten phase has passed into the solid state.

Figure 4B:
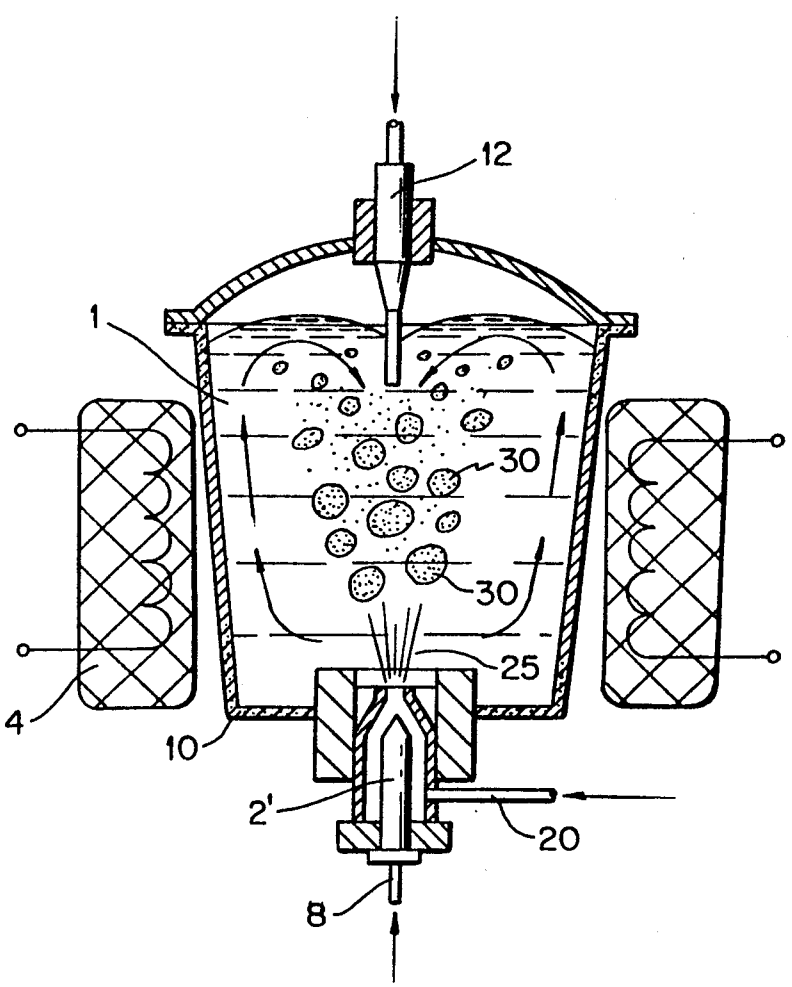
Figure 4A:
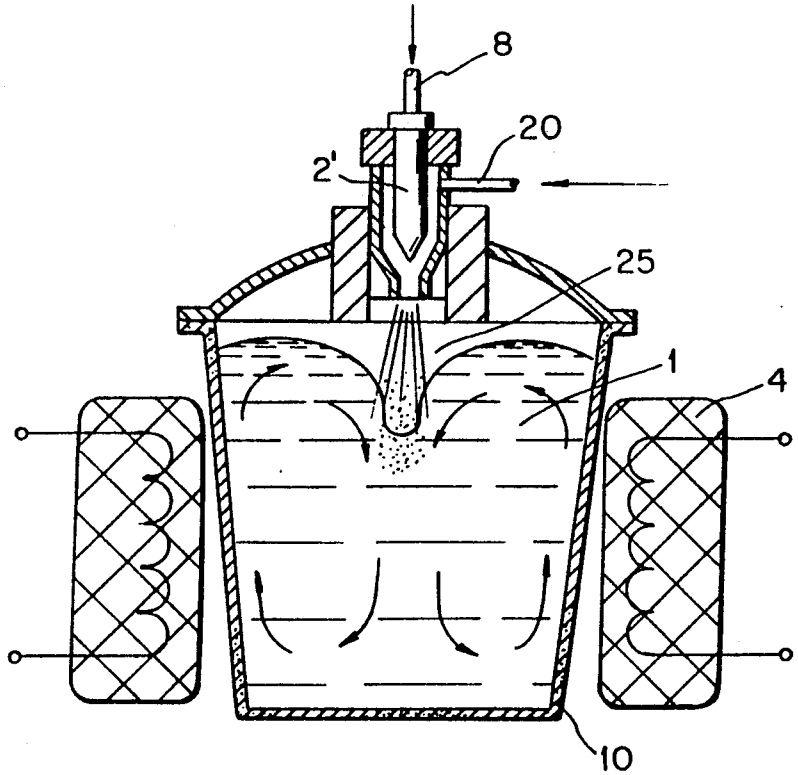

FIG. 4(A) shows the crucible of FIG. 1 provided with a conduit (20) for introducing reactant into ionization chamber (2') with an increased velocity of the ionized gas being indicated at (25) resulting in deeper penetration of the additive into the metal bath. FIG. 4(B) shows the crucible of FIG. 4(A) with ionized gas and additive being introduced at the bottom of the ladle. The inert gas forms bubbles (30) which are broken up and dispersed by ultrasonic transducer (12) in contact with the upper portion of the metal bath at its surface.

Figure 5:
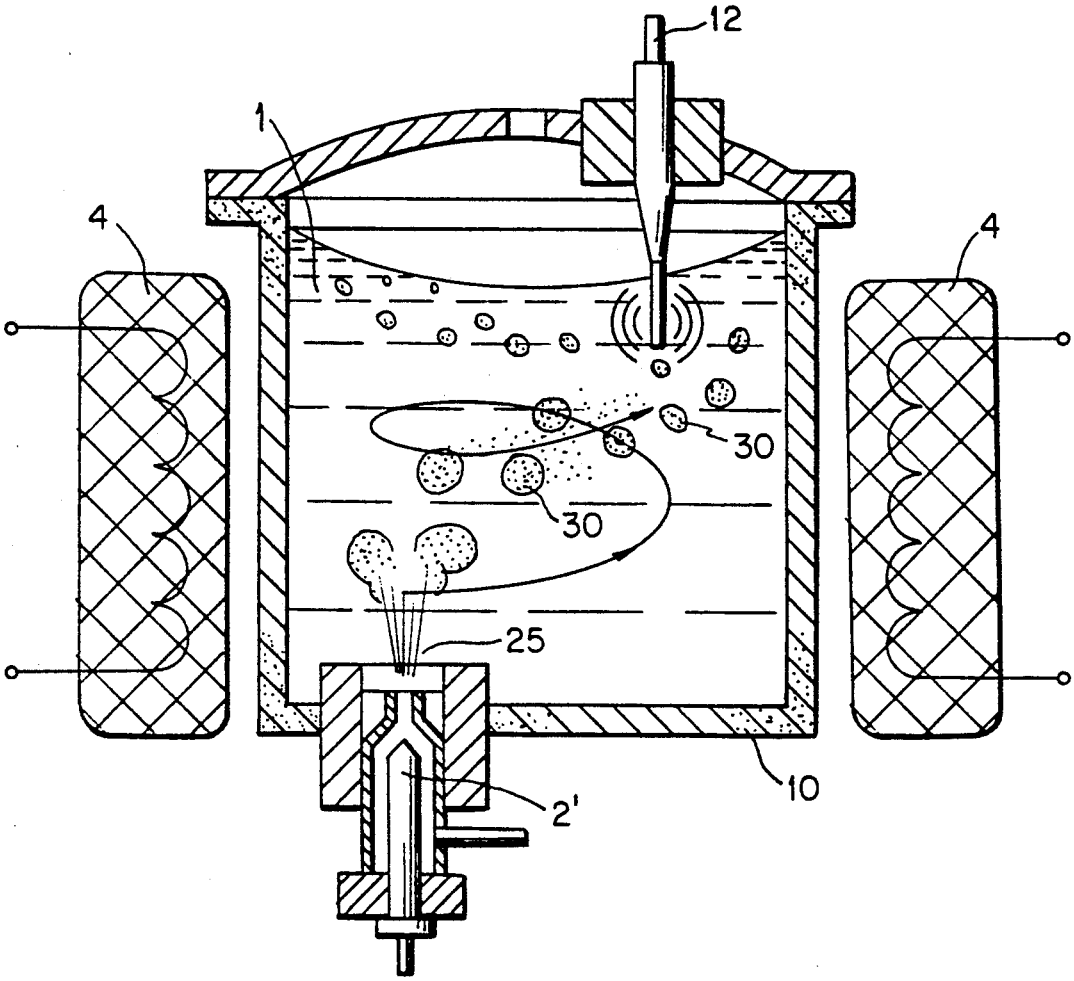

FIG. 5 shows the crucible of FIG. 4(B) with the ultrasonic transducer (12) and the injection of ionized gas (25) being offset from the central alignment of FIG. 4(B) to achieve the illustrated upwardly spiralling movement of the particle containing bubbles (30).

EXAMPLE

For testing the method of the invention use was made of unalloyed metals-aluminum and iron, as well as an aluminum base alloy 4%Cu, 1.5% Mg, 0.5% Mn also known as D16. These materials were separately used as the base melt for production of various composite materials. The starting reinforcing materials used were powdered silicon carbide, 5–50 micron in size, titanium aluminide $TiAl_3$ with particle size of 1–10 micron, and also titanium powder 10–100 micron in size.

Tests to produce composite materials were run in the pilot unit, shown schematically in FIG. 1. The crucible was made of graphite and contained a matrix melt (1) which was injected with a stream of ionized argon gas with entrained reinforcing particles preheated to predetermined temperature by means of a conventional plasmatron type ionization device (2) fitted with the metering device (3) to establish a predetermined rate of powder flow through the ionization device. The temperature of the particles, $T_p$ was varied and was monitored by detecting the change in neat content of the base melt before and after injection of particles of powder. $T_p$ was calculated by the formula:

$$T_p = \theta \frac{C_m}{C_p} \frac{M_m}{M_p} \left(1 - \frac{T_m \cdot (1 + K_N)}{\theta}\right)$$

where:

$\theta$—melt temperature after inject of additives, ° C.;

$T_m$—matrix temperature before injection of additives, ° C.;.

$C^m$—specific heat of matrix metal, $M_m$—metal mass, $K_g$ $C_p$—specific heat of particles, $M_p$—particles, mass, Kg $K_n$—dimensionless factor taking into account heat effects upon air cooling of melt surface during preheating in treatment by stream of ionized gas without injection of particles, $K_n$=0.05–0.06 for 5 Kg of molten metal and an metal and an ionized argon gas flow of 0.1 $M^3$/min.

Stirring the mix in the course of injection of additives casting was accomplished by means of the magnetic inductor (4). After injection of predetermined quantities of solid additives the plug (5) was removed from the crucible and a liquids-solid mixture flowed through the hole in the crucible bottom to fill a casting mold made of steel. The steel mold (6), 50 mm diameter, was used and the molten metal-solid particle mix was stirred by ultrasound generator (7) until the mold contents solidified. The resulting solid casting of 2.5 kg. was hot extruded. Quality assessment of resulting composite material was determining the following parameters:

chemical and structural uniformity, size of reinforcing particles, strength of composite material.

Chemical non-uniformity of composite material was evaluated by change in content of components of reinforcing particles in various cross-sections of the casting across the casting direction by determining the chemical non-uniformity factor K:

$$K_c = \frac{C_{max} - C_{min}}{\frac{1}{n} \sum_{k=1}^{n} C_k}$$

Where:

$C_k$—content of components of reinforcing particles in cross-section of the casting, wt. %;

n—number of cross sections analyzed;

$C_{max}$ $C_{min}$—maximum and minimum content of components of reinforcing particles in cross-sections, wt. %.

Structural non-uniformity of the composite material was assessed by change of average sizes of reinforcing particles by the factor $K_{ave}$:

$$K_{ave} = \frac{d_{max} - d_{min}}{\frac{1}{n} \sum_{i=1}^{n} d_i}$$

Where $d_i$—average size of i-th particle, micron;

$d_{max}$ $d_{min}$—maximum and minimum sizes of analyzed particles n—number of analyzed particles.

Strength was assessed by measuring the ultimate tensile strength $R_m$, MPa (UTS). Chemical composition was determined by the quantimeter ARL 72000, with a precision of±0.01%; structural characteristics were determined by the metallographic optic microscope MeF-3A at magnifications up to 3,000×and the structural analyzer Omnimet 2 for quantitative determination of elements in the structure. Determination of strength was by the tensile machine UTS-100 with maximum applied force of 100 KN. All of the foregoing equipment is state-of-the-art. Table 1 shows the results of the tests.

The resulting data proves that the best characteristics are ensured by the samples of composite materials produced in the experiments No. 6, 9, 12, 36, 42, 51, 57, 66, 69, 72 in accordance with the method of the present invention for production of metal base composite materials.

In a further embodiment of the present invention, filler material for the making of a composite material is synthesized in the environment of an ionized entraining gas and the thus produced nascent materials, shielded by the cleaning ionized gas, are introduced into the base metal melt which is physically agitated, e.g. by magnetic and ultrasound techniques to uniformly distribute the synthesized material in the base metal matrix. The filler materials are synthesized by introducing substantially stoichiometric amounts of the reactants for producing the filler material. For example, in making titanium nitride filler material titanium powder suitable sized 20–50 micron is entrained in nitrogen gas in proportions corresponding to the equation:

$$2\,Ti + N_2 \cdots 2\,TiN$$

The titanium/nitrogen mixture is passed into a stream of ionized inert gas and exposed to the ionized gas at a temperature in the range of 2200–3000 degrees C for a time sufficient to complete reaction between the titanium and nitrogen to form titanium nitride in vapor form which is carried by the ionized inert gas onto the surface of the base metal melt, e.g. aluminum, which is physically agitated to uniformly disperse the titanium nitride in small discrete volumes which, on solidification in the base metal, provide ultrafine strengthening filler particles.

Other filler materials can be similarly synthesized as follows:

$$3Si\ (powder) + 2N_2 \cdots Si_3N_4$$

Ti (powder)+3Al (powder) - - - $TiAl_3$

The temperature of the base metal melt is maintained at a temperature which will quench the additive materials so that the synthesized additive material is not undesirably dissolved in the melt.

In another embodiment of the invention, a carbon bearing gas, such as the hydrocarbons, propane, butane natural gas, methane, or carbon monoxide, carbon dioxide are ionized in mixture with a stream of ionized inert gas and dissociated. The carbon dissociation product is monatomic elemental carbon which is injected into the base melt as a filler addition. For the oxygen bearing gases, the liberated monatomic oxygen is an ionized gas stream which reacts with the melt, e.g. aluminum, to form ultrafine filler particles of aluminum oxide, $Al_2O_3$ in the melt.

Following the practice of the present invention under the condition of Table 2 and using the materials of Table 2, the indicated additives were introduced into the indicated molten base metal matrix to produce composite materials having improved mechanical properties.

TABLE 1

TEST RESULTS

| Item No. 1 | Flow rate of particles Kg/min | Flow Rate of Inert Gas $M_3$/min | Matrix Temperature °C. | Matrix Material 2 | Reinforcing material 3 | Power preheating temperature °C. 4 | Change in quanitity of liquid phase W/stirring % 5 | Composition of composite material 6 | Average size of reinforcing particles micron 7 | $K_c$ 8 | $K_{ave}$ 9 | $R_m$ MPa 10 |
|---|---|---|---|---|---|---|---|---|---|---|---|---|
| 1 | 0.14 | 0.12 | 670 | Al | 20% SiC | 880 | 100-80 | Al—SiC | 20 | 0.5 | 2.2 | 160 |
| 2 | " | " | " | " | " | " | 80-0 | " | 20 | 0.6 | 2.2 | 150 |
| 3 | " | " | " | " | " | " | 100-0 | " | 20 | 0.4 | 2.2 | 180 |
| 4 | 0.11 | 0.11 | " | " | " | 1100 | 100-80 | " | 8 | 0.4 | 0.8 | 215 |
| 5 | " | " | " | " | " | " | 80-0 | " | 8 | 0.5 | 0.8 | 205 |
| 6 | " | " | " | " | " | " | 100-0 | " | 8 | 0.1 | 0.8 | 250 |
| 7 | 0.08 | 0.10 | " | " | " | 1540 | 100-80 | " | 7 | 0.4 | 0.7 | 220 |
| 8 | " | " | " | " | " | " | 80-0 | " | 7 | 0.5 | 0.7 | 210 |
| 9 | " | " | " | " | " | " | 100-0 | " | 7 | 0.08 | 0.7 | 255 |
| 10 | 0.05 | 0.09 | " | " | " | 2000 | 100-80 | " | 6 | 0.4 | 0.5 | 225 |
| 11 | " | " | " | " | " | " | 80-0 | " | 6 | 0.5 | 0.5 | 220 |
| 12 | " | " | " | " | " | " | 100-0 | " | 6 | 0.07 | 0.5 | 260 |
| 13 | 0.02 | 0.08 | " | " | " | 2200 | 100-80 | " | 15 | 0.3 | 3 | 195 |
| 14 | " | " | " | " | " | " | 80-0 | " | 15 | 0.4 | 4 | 190 |
| 15 | " | " | " | " | " | " | 100-0 | " | 15 | 0.18 | 2 | 200 |
| 16 | 0.15 | 0.12 | Al | 670 | 5% Ti | 720 | 100-95 | Al—Ti—$TiAl_3$ | 50 | 0.4 | 6 | 170 |
| 17 | " | " | " | " | " | " | 95-0 | " | 60 | 0.5 | 8 | 160 |
| 18 | " | " | " | " | " | " | 100-0 | " | 45 | 0.3 | 5 | 200 |
| 19 | 0.12 | 0.11 | " | " | " | 900 | 100-95 | " | 40 | 0.4 | 6 | 195 |
| 20 | " | " | " | " | " | " | 95-0 | " | 45 | 0.5 | 7 | 185 |
| 21 | " | " | " | " | " | " | 100-0 | " | 30 | 0.3 | 5 | 250 |
| 22 | 0.9 | 0.10 | " | " | " | 1250 | 100-95 | " | 40 | 0.4 | 6 | 195 |
| 23 | " | " | " | " | " | " | 95-0 | " | 45 | 0.5 | 6 | 190 |
| 24 | " | " | " | " | " | " | 100-0 | " | 25 | 0.3 | 5 | 260 |
| 25 | 0.6 | 0.9 | " | " | " | 1600 | 100-95 | " | 30 | 0.3 | 5 | 250 |
| 26 | " | " | " | " | " | " | 95-0 | " | 35 | 0.4 | 6 | 220 |
| 27 | " | " | " | " | " | " | 100-0 | Al—$TiAl_3$ | 20 | 0.2 | 4 | 280 |
| 28 | 0.3 | 0.8 | " | " | " | 1800 | 100-95 | " | 30 | 0.2 | 4 | 250 |
| 29 | " | " | " | " | " | " | 95-0 | " | 40 | 0.3 | 5 | 210 |
| 30 | " | " | " | " | " | " | 100-0 | " | 20 | 0.15 | 3 | 300 |
| 31 | 0.18 | 0.12 | " | " | 15% $TiAl_3$ | 540 | 100-85 | " | 7 | 0.3 | 2 | 290 |
| 32 | " | " | " | " | " | " | 85-0 | " | 7 | 0.6 | 2 | 280 |
| 33 | " | " | " | " | " | " | 100-0 | " | 7 | 0.4 | 2 | 300 |
| 34 | 0.15 | 0.11 | " | " | " | 670 | 100-85 | " | 4 | 0.4 | 0.8 | 320 |
| 35 | " | " | " | " | " | " | 85-0 | " | 4 | 0.6 | 0.6 | 310 |
| 36 | " | " | " | " | " | " | 100-0 | " | 4 | 0.6 | 0.5 | 400 |
| 37 | 0.12 | 0.10 | Al | 670 | 15% $TiAl_3$ | 940 | 100-85 | Al—$TiAl_3$ | 3 | 0.3 | 0.6 | 310 |
| 38 | " | " | " | " | " | " | 85-0T | " | 3 | 0.4 | 0.6 | 300 |
| 39 | " | " | " | " | " | " | 100-0 | " | 3 | 0.05 | 0.6 | 420 |
| 40 | 0.09 | 0.09 | " | " | " | 1200 | 100-85 | " | 2 | 0.2 | 0.4 | 340 |
| 41 | " | " | " | " | " | " | 85-0 | " | 2 | 0.3 | 0.4 | 320 |
| 42 | " | " | " | " | " | " | 100-0 | " | 2 | 0.05 | 0.4 | 440 |
| 43 | 0.06 | 0.08 | " | " | " | 1340 | 100-85 | " | 15 | 0.2 | 3 | 270 |
| 44 | " | " | " | " | " | " | 85-0 | " | 20 | 0.3 | 4 | 250 |
| 45 | " | " | " | " | " | " | 100-0 | " | 10 | 0.1 | 2 | 300 |
| 46 | 0.14 | 0.12 | 16 | 660 | 20% SiC | 880 | 100-80 | D16-SiC | 20 | 0.4 | 2 | 400 |
| 47 | " | " | " | " | " | " | 80-0 | " | 20 | 0.5 | 2 | 390 |
| 48 | " | " | " | " | " | " | 100-0 | " | 20 | 0.3 | 2 | 420 |
| 49 | 0.11 | 0.11 | " | " | " | 1100 | 100-80 | " | 8 | 0.3 | 0.7 | 480 |
| 50 | " | " | " | " | " | " | 80-0 | " | 8 | 0.4 | 0.7 | 470 |
| 51 | " | " | " | " | " | " | 100-0 | " | 8 | 0.09 | 0.7 | 620 |
| 52 | 0.08 | 0.10 | " | " | " | 1540 | 100-80 | " | 7 | 0.3 | 0.6 | 490 |
| 53 | " | " | " | " | " | " | 80-0 | " | 7 | 0.4 | 0.6 | 480 |
| 54 | " | " | " | " | " | " | 100-0 | " | 7 | 0.07 | 0.6 | 640 |
| 55 | 0.05 | 0.09 | " | " | " | 2000 | 100-80 | " | 6 | 0.3 | 0.5 | 520 |
| 56 | " | " | " | " | " | " | 80-0 | " | 6 | 0.4 | 0.5 | 500 |
| 57 | " | " | " | " | " | " | 100-0 | " | 6 | 0.05 | 0.5 | 660 |
| 58 | 0.02 | 0.08 | Al6 | 660 | 20% SiC | 2200 | 100-80 | D16-SiC | 15 | 0.2 | 2.5 | 410 |

TABLE 1-continued

TEST RESULTS

| Item No. 1 | Flow rate of particles Kg/min | Flow Rate of Inert Gas $M_3$/min | Matrix Temperature °C. | Matrix Material 2 | Reinforcing material 3 | Power preheating temperature °C. 4 | Change in quanitity of liquid phase W/ stirring % 5 | Composition of composite material 6 | Average size of reinforcing particles micron 7 | $K_c$ 8 | $K_{ave}$ 9 | $R_m$ MPa 10 |
|---|---|---|---|---|---|---|---|---|---|---|---|---|
| 59 | " | " | " | " | " | " | 80–0 | " | 15 | 0.3 | 3 | 400 |
| 60 | " | " | " | " | " | " | 100–0 | " | 15 | 0.09 | 1.5 | 420 |
| 61 | 0.14 | 0.12 | Fe | 1540 | 20% SiC | 880 | 100–80 | Fe—SiC | 20 | 0.6 | 2.5 | 620 |
| 62 | " | " | " | " | " | " | 80–2 | " | 20 | 0.7 | 2.5 | 600 |
| 63 | " | " | " | " | " | " | 100–0 | " | 20 | 0.5 | 2.5 | 650 |
| 64 | 0.11 | 0.11 | " | " | " | 1100 | 100–80 | " | 8 | 0.5 | 0.9 | 690 |
| 65 | " | " | " | " | " | " | 80–0 | " | 8 | 0.6 | 0.9 | 680 |
| 66 | " | " | " | " | " | " | 100–0 | " | 8 | 0.12 | 0.9 | 790 |
| 67 | 0.08 | 0.10 | " | " | " | 1540 | 100–80 | " | 7 | 0.4 | 0.8 | 710 |
| 68 | " | " | " | " | " | " | 80–0 | " | 7 | 0.6 | 0.8 | 700 |
| 69 | " | " | " | " | " | " | 100–0 | " | 7 | 0.10 | 0.08 | 800 |
| 70 | 0.05 | 0.09 | " | " | " | 2000 | 100–80 | " | 6 | 0.3 | 0.7 | 720 |
| 71 | " | " | " | " | " | " | 80–0 | " | 6 | 0.5 | 0.7 | 700 |
| 72 | " | " | " | " | " | " | 100–0 | " | 6 | 0.8 | 0.7 | 810 |
| 73 | 0.02 | 0.08 | " | " | " | 2200 | 100–80 | " | 15 | 0.4 | 3.5 | 610 |
| 74 | " | " | " | " | " | " | 80–0 | " | 15 | 0.5 | 4 | 600 |
| 75 | " | " | " | " | " | " | 100–0 | " | 15 | 0.1 | 2.5 | 640 |

TABLE 2

| Matrix Metal Kg | Matrix Temp C. | Reactant #1 | Reactant #2 | Ionized Gas Flow (SCFM) & Temp. C. | Addition | Amount of Addition wt. % | FIG. 4 (B) | Apparatus FIG. 5 |
|---|---|---|---|---|---|---|---|---|
| Al 4.22 kg | 670 | Al 5–50 micron 0.02 kg/min | Ti 5–50 micron 0.04 kg/min | 14000 | $TiAl_3$ | 15 | + | + |
| Cu 4.9 kg | 980 | Si 5–50 micron 0.02 kg/min | $N_2$ 0.008 M3/min | 14000 | $Si_3N_4$ | 2 | + | + |
| Fe 4.75 | 1540 | Ti 5–50 micron 0.04 kg/min | $CO_2$ 0.013 M3/min | 14000 | TiC | 5 | + | + |
| Al 12% Si 4.9 | 660 | Ti 5–50 min 0.04 kg/min | $N_2$ 0.005 M3/min | 14000 | TiN | 2 | + | + |

What is claimed is:

1. A method of making a composite material, comprising:

(a) entraining finely divided solid additive particles having surfaces in a stream of ionized inert gas;

(b) preheating said finely divided solid additive particles to a temperature between 0.5–0.9 of a melting point of said solid, additive particles to provide sufficient degree of activation for interphase action to achieve a sufficient bond between said additive particles and a base metal and to prevent agglomeration of said additive particles into a large formation during mixing of said additive particles in the molten base metal;

wherein said temperature of preheating said finely divided solid additive particles is determined in accordance with the formula $$T_p = \theta \frac{C_m}{C_p} \frac{M_m}{M_p} \left(1 - \frac{T_m \cdot (1 + K_n)}{\theta}\right)$$

wherein:

$\theta$—temperature of said molten base metal after injection of said additive particles, ° C.;

$T_m$—molten base metal temperature before injection of said additive particles, ° C.;

$C_m$—specific heat of the base metal $$\frac{KJ}{Kg\Delta t\ °C.};$$

$M_m$—said metal base mass, Kg;

$C_p$—specific heat of said additive particles $$\frac{KJ}{Kg\Delta t\ °C.};$$

$M_p$—mass of said additive particles, Kg;

$K_n$—dimensionless factor taking into account heat effects upon air cooling of melt surface during preheating in treatment by stream of ionized gas without injection of the additive particles, $K_m$=0.05–0.06 for 5 Kg of the molten metal and an ionized argon gas flow of 0.1 $M^3$/min.

(c) injecting said stream of ionized inert gas and said entrained preheated additive particles deep into a body of molten base metal; forming a mixture of said additive particles and said molten base metal;

(d) continuously agitating said mixture during all phases of formation of said composite material to establish a substantially uniform distribution of said additive particles in the molten metal; and (e) conveying said mixture into a suitable mold.

2. A method according to claim 1, wherein thermodynamic stability of said additive particles in the molten base metal inhibits their chemical action with said base metal and formation of undesirable compounds of uncontrolled sizes and shapes, thus ensuring formation of superfine particle-reinforced alloys by melting said base metal, followed by combined crystallization and heat treatment.

3. A method according to claim 1, wherein said sufficient degree of activation of said additive particles is achieved by removal of absorbed oxygen from the surfaces of said additive particles.

4. A method according to claim 1, wherein said temperature of preheating said finely divided solid additive particles is monitored by detecting a predetermined change in said molten base metal before and after the injection of said additive particles.

5. A method according to claim 1, wherein said continuous agitation is accomplished by means of a magnetic inductor.

6. A method according to claim 1, wherein said base metal is an aluminum base alloy including 4%Cu, 1.5% Mg, 0.5% Mn, and said additive particles are powdered silicon carbide, 5–50 micron in size, titanium aluminide with particle size of 1–10 micron, and titanium powder 10–100 micron in size.

7. A method according to claim 1, wherein said mixture of additive and molten base metal is initially contained in a base metal bath and said agitation is provided by magnetic means external to said bath and subsequently a portion of said mixture is transferred to a mold and agitation of the mixture is provided by ultrasound means external to the mold.

8. A method according to claim 1, wherein said base metal is selected from aluminum, iron, magnesium, copper, nickel, chromium, and titanium.

9. A method according to claim 8, wherein said additive particles are selected from carbides, nitrides, carbonitrides, oxides and borides of metals.

10. A method of making a composite material, comprising:

(a) entraining finely divided solid additive particles having surfaces in a stream of ionized inert gas;

(b) selecting a predetermined temperature;

(c) preheating said finely divided solid additive particles to said predetermined temperature, said predetermined temperature of preheating said finely divided solid additive particles is determined in accordance with the formula $$T_p = \theta \frac{C_m}{C_p} \frac{M_m}{M_p} \left(1 - \frac{T_m \cdot (1 + K_n)}{\theta}\right).$$

wherein:

$\theta$—temperature of said molten base metal after injection of said additive particles, ° C.;

$T_m$—molten base metal temperature before injection of said additive particles, ° C.;

$C_m$—specific heat of the base metal $$\frac{KJ}{Kg\Delta t\,°C.};$$

$M_m$—said metal base mass, Kg;

$C_p$—specific heat of said additive particles $$\frac{KJ}{Kg\Delta t\,°C.};$$

$M_p$—mass of said additive particles, Kg;

$K_n$—dimensionless factor taking into account heat effects upon air cooling of melt surface during preheating in treatment by stream of ionized gas without injection of the additive particles, $K_n = 0.05–0.06$ for 5 Kg of the molten metal and an ionized argon gas flow of 0.1 $M^3$/min;

(d) injecting said stream of ionized inert gas of said entrained preheated additive particles deep into a body of molten base metal; forming a mixture of said additive particles and said molten base metal; and (e) conveying said mixture into a suitable mold.

11. A method according to claim 10 further comprising a step of continuously agitating said mixture during all phases of formation of said composite material to establish a substantially uniform distribution of said additive particles in the molten base metal.

12. A method according to claim 11, wherein in order to prevent oxidation of said additive particles said stream of ionized inert gas and said entrained preheated additive particles are injected directly into said interior of the molten base metal without being exposed to an outside environment.

13. A method according to claim 12, wherein said molten base metal forms a base metal bath; and said stream of ionized inert gas and said solid particles are injected into said bath to a depth of at least 5 cm or 10% of the bath depth.

14. A method according to claim 13, wherein said stream of ionized inert gas and said solid particles are injected into the interior of the molten base metal from beneath said base metal bath.

15. A method according to claim 12, wherein said base metal bath is covered and said mixture is injected through said cover.

16. A method according to claim 11, wherein said mixture of additive and molten base metal is initially contained in a base metal bath and said agitation is provided by magnetic means external to the bath and subsequently a portion of said mixture is transferred to a mold and agitation of the mixture is provided by ultrasound means external to the mold.

17. A method according to claim 11, wherein said base metal is selected from aluminum, iron, magnesium, copper, nickel, chromium, and titanium.

18. A method according to claim 17, wherein said additive particles are selected from carbides, nitrides, carbonitrides, oxides and borides of metals.

* * * * *